US010297125B2

(12) United States Patent
Mc Donagh et al.

(10) Patent No.: US 10,297,125 B2
(45) Date of Patent: May 21, 2019

(54) EMERGENCY EXIT SIGN

(71) Applicants: Bernard Mc Donagh, Glynde (GB); Brian Stevens, Seaford (GB)

(72) Inventors: Bernard Mc Donagh, Glynde (GB); Brian Stevens, Seaford (GB)

(73) Assignee: EVACLITE LTD, Dorking (GB)

( * ) Notice: Subject to any disclaimer, the term of this patent is extended or adjusted under 35 U.S.C. 154(b) by 0 days.

(21) Appl. No.: 14/782,517

(22) PCT Filed: Apr. 2, 2014

(86) PCT No.: PCT/GB2014/051033
§ 371 (c)(1),
(2) Date: Oct. 5, 2015

(87) PCT Pub. No.: WO2014/162131
PCT Pub. Date: Oct. 9, 2014

(65) Prior Publication Data

US 2016/0027266 A1 Jan. 28, 2016

Related U.S. Application Data

(60) Provisional application No. 61/808,882, filed on Apr. 5, 2013.

(51) Int. Cl.
*G09F 13/14* (2006.01)
*G08B 7/06* (2006.01)
(Continued)

(52) U.S. Cl.
CPC ..... *G08B 7/066* (2013.01); *G08B 7/062* (2013.01); *G09F 13/04* (2013.01); *G09F 19/22* (2013.01);
(Continued)

(58) Field of Classification Search
CPC ..... G08B 7/066; G08B 7/062; G09F 13/04; G09F 19/22
(Continued)

(56) References Cited

U.S. PATENT DOCUMENTS 3,961,434 A * 6/1976 Sampon ..... G09F 13/34 40/437
4,967,317 A * 10/1990 Plumly ..... G08B 7/062 362/243
(Continued)

FOREIGN PATENT DOCUMENTS

| | | |
|---|---|---|
| EP | 0881616 | 12/1998 |
| WO | WO 2008111024 | 9/2008 |
| WO | WO 2014/162131 | 10/2014 |

OTHER PUBLICATIONS

International Search Report for International Application No. PCT/GB2014/051033, dated Jul. 4, 2014.

*Primary Examiner* — John A Tweel, Jr.
*Assistant Examiner* — Munear T Akki
(74) *Attorney, Agent, or Firm* — William H. Bollman

(57) ABSTRACT

Described is a dynamic emergency exit sign comprising one or more pictograms and at least one light source for accentuating one or more of the one or more pictograms either singly or in combination, wherein at least one light source is controlled by signals from evacuation computer modelling software to assist occupants egress in emergency or other critical situations.

19 Claims, 10 Drawing Sheets

(51) Int. Cl.
*G09F 13/04* (2006.01)
*G09F 19/22* (2006.01)

(52) U.S. Cl.
CPC ..... *G09F 2013/0459* (2013.01); *G09F 2019/225* (2013.01)

(58) Field of Classification Search
USPC ..... 340/908, 915, 815.4
See application file for complete search history.

(56) References Cited

U.S. PATENT DOCUMENTS 5,018,290 A * 5/1991 Kozek ..... G09F 13/04 362/240
5,254,908 A * 10/1993 Alt ..... H05B 37/0272 315/312
5,526,236 A * 6/1996 Burnes ..... G09F 13/04 257/E25.028
6,971,196 B2 * 12/2005 Fernandez ..... G09F 3/04 40/452
7,350,327 B1 * 4/2008 Logan ..... G09F 7/18 40/570
2003/0046842 A1 * 3/2003 Maas ..... G02B 6/0036 40/546
2006/0012487 A1 * 1/2006 Gibson ..... G08B 5/006 340/815.45
2006/0215403 A1 * 9/2006 Martineau ..... G09F 13/04 362/240
2006/0225328 A1 * 10/2006 Hasan ..... G09F 13/18 40/570
2010/0013658 A1 * 1/2010 Chen ..... G09F 13/04 340/815.4
2010/0309004 A1 * 12/2010 Grundler ..... A62B 3/00 340/588
2011/0232143 A1 9/2011 Hsu

* cited by examiner

EMERGENCY EXIT SIGN

The present invention relates to emergency exit signs, in particular to emergency exit signs adapted for providing more effective information in the event of an emergency.

Illuminated fire exit signs seen in public buildings and offices around the world are used to identify the fire evacuation exit routes and a final exit. These signs conform to various international codes such as ISO7010/ISO3864-1 and UL924. Most of these signs are either constantly illuminated or illuminate upon power failure. They show pictogram type symbols such as a running man, a door and an arrow or the word EXIT and chevrons depicting the route to take during an emergency. Most of these signs are required under these codes to exhibit a specific amount of illumination and to provide an emergency back-up power source for a specified period of time should the power fail. In the main, these type of signs are adequate when they are seen by people during an evacuation; however recent academic studies have suggested and proven that current fire exit signs covered by these international standards are less effective as an aid to emergency egress than they potentially can be.

It is, therefore, an object of the present invention to seek to alleviate the above identified problems.

SUMMARY OF THE INVENTION

According to one aspect of the present invention, there is provided a dynamic emergency exit sign comprising one or more pictograms and at least one light source for accentuating one or more of the one or more pictograms either singly or in combination, wherein the at least one light source is controlled by signals from evacuation computer modelling software to assist occupants egress in emergency or other critical situations.

Preferably, the sign comprises a microprocessor for changing which of the one or more light sources is lit according to information received from evacuation computer modelling software.

Preferably, the one or more pictograms comprise one or more arrows, chevrons, running men and/or doorways.

Preferably, the at least one light source is behind the one or more pictograms.

Preferably, the at least one light source is controlled to chase, strobe, blink and/or selectively turn on and off.

Preferably, the at least one light source forms the shape of one or more of the one or more pictograms.

Preferably, the at least one light source reacts to information received from evacuation computer modelling software to activate either an arrow or a cross.

Preferably, the at least one light source comprises one or more LED light sources.

Preferably, the at least one light source comprises a matrix of LED light sources.

Preferably, the at least one light source comprises a matrix of LEDs embedded on a printed circuit board.

Preferably, the at least one light source comprises a matrix of LEDs embedded onto a printed circuit board and forming the shape of one or more of the one or more pictograms.

Preferably, the at least one light source comprises a matrix of pulsating LED components embedded on a printed circuit board.

Preferably, the sign comprises a micro-processor which drives the at least one light source, preferably LEDs, in a sequence to form a moving arrow or pulsating cross and prompt people to move in the direction suggested by the sign or to not move if the red cross is showing.

Preferably, the at least one light source, preferably LEDs, are controlled, for example microprocessor controlled, to be chasing or flashing.

Preferably, the at least one light source is controlled in a chasing sequence to form a moving arrow.

Preferably, the micro-processor drives the at least one light source, preferably LEDs, in a chasing sequence to form a moving arrow.

Preferably, the sequence comprises a three section movement.

Preferably, the at least one light source is controlled to form a pulsating cross.

Preferably, the microprocessor drives the at least one light source, preferably LEDs, to form a pulsating cross.

Preferably, the printed circuit board is made of a translucent material or is coloured white.

Preferably, the at least one light source is for indicating a cross.

Preferably, the cross is across all of the one or more pictograms.

Preferably, the cross is a red cross.

Preferably, the cross runs diagonal through the sign to all four corners. In this respect, it will be appreciated that the cross is not for accentuating the one or more pictograms.

Preferably, the cross is not for accentuating the one or more pictograms.

Preferably, the sign comprises perforated printing. Preferably, the perforated printing is for increasing the light levels of the one or more light source behind the one or more pictograms.

Preferably, the perforated printing is for keeping the required contrast levels of the sign according to standards.

Preferably, the sign is single- or double-sided.

Preferably, the sign is an active LED array fire exit escape route sign that interprets fire or evacuation computer modelling software to show or change the direction of escape or bar an escape route from being used.

Preferably, the LEDs either flash or chase to create a moving arrow in the required direction or a static or pulsating red cross to stop or hold an exit from use.

Preferably, the sign is multi-directional, preferably with the arrow directing up or down, left or right and/or diagonally up left or right or diagonally down left or right.

Preferably the sign is manufactured as a complete fire emergency escape route or exit sign.

Preferably, the sign is for retrofitting into existing signs.

According to another aspect of the present invention, there is provided an active LED array Fire Exit Escape Route sign that interprets fire/evacuation computer modelling software to show/change the direction of escape or bar an escape route exit from being used.

Preferably, the LEDs either flash or chase to create a moving arrow in the required direction or static/pulsating red cross to stop/hold an exit from use.

Preferably, the sign is multi directional with the arrow directing up/down or /left/right and/or diagonally up left/right or diagonally down left/right.

Preferably, the sign is manufactured as a complete Fire Emergency Escape Route/Exit sign.

Preferably, the sign is manufactured for retrofitting into existing signs.

According to another aspect of the present invention, there is provided a sign for indicating an escape route from a building, the sign comprising information and at least one light source for selectively illuminating said information in response to input received from evacuation computer modelling software.

Preferably, the information comprises one or more pictograms and/or one or more words.

Preferably, the at least one light source comprises one or more LEDs.

Preferably, the at least one light source is provided on a removable panel.

Preferably, the information is illuminated in a series of steps, for example three sequential steps.

Preferably, the sign comprises one or more areas of increased light permeability for light from the one or more light sources to pass.

Preferably, the one or more areas of increased light permeability are configured such that when information is not illuminated, the one or more areas of increased light permeability do not substantially interrupt the appearance of the information.

Preferably, the one or more areas of increased light permeability comprise a perforated printed surface.

Preferably, the one or more areas of increased light permeability comprise one or more circles of perforated printing.

Preferably, the one or more areas of increased light permeability comprise a square grid pattern, for example linear square grid printing.

Preferably, the linear square grid printing is coloured to match the background colour of the existing graphic in the position where the LED is behind.

Preferably, the linear square grid printing matches the background colour where two background colours of the graphic overlap.

Preferably, the one or more areas of increased light permeability are positioned in alignment with the at least one light source.

Preferably, the at least one light source comprises a plurality of LEDs and one or more of the LEDs is positioned behind an area of increased light permeability.

Preferably, the at least one light source is provided behind a panel comprising the information.

Preferably, the sign comprises first and second faces comprising information and first and second sets of light sources, a first set comprising at least one light source for illuminating information provided on the first face and a second set comprising at least one light source for illuminating information on the second face.

Preferably, the first and second sets of at least one light source are provided on opposing sides of a light source panel for positioning between the first and second faces.

Preferably, the first and second sets of at least one light source are for illuminating the same or different information on each of the first and second faces.

Preferably, the first and second sets of at least one light source are controllable independently to highlight different information on each of the first and second faces. For example, in operation, it will be appreciated that a red cross could be illuminated on one face whilst a green arrow or chevron could be illuminated on an opposing face.

Preferably, the at least one light source comprises a plurality of light sources specifically arranged behind individual items of the information.

Preferably, the at least one light source corresponds to the outline of information on the sign.

For example, it is preferred that a plurality of LEDs are provided on a PCB in an arrangement corresponding to one or more pictograms and/or one or more words on the sign.

Preferably, the at least one light source forms a cross.

Preferably, the cross extends across information on the sign. In this respect, it will be appreciated that the cross is not for illuminating information on the sign.

Preferably, at least part of the cross flashes in use.

Preferably, the four corners of the cross flash in use.

Preferably, the four corners of the cross flash in pairs and/or sequentially.

Preferably, the at least one light source is for illuminating information on the sign in a series of sequential steps, preferably about three steps.

Preferably, the at least one light source is for illuminating an arrow or chevron on the sign in a series of sequential steps along the arrow or chevron. In this way, it will be appreciated that the direction of the arrow or chevron will be highlighted.

Preferably, the at least one light source is for sequentially illuminating the shaft and then the head of an arrow on the sign.

Preferably, the at least one light source is for sequentially illuminating the outer edges of a chevron and then the leading centre of a chevron on the sign.

Preferably, the LEDs providing the dynamic features of the sign are provided as an integral unit releasably mounted on a central chassis to facilitate easy replacement thereof.

Preferably, the sign comprises a housing defining an enclosure and including means for defining one or more translucent covers provided with the pictograms or wording.

Preferably, a PCB is mounted on a central chassis in a generally parallel arrangement with and spaced from a translucent cover or covers of the sign.

Preferably, a plurality of LEDs are mounted in a desired pattern on a PCB to fully illuminate translucent cover or covers of the sign in a uniform manner.

Preferably, the housing is generally rectangular in shape comprising top and bottom walls, a pair of side walls and a pair of end walls.

Preferably, the housing comprises a two part construction wherein the parts are connected together, for example by screws.

Preferably, the sign comprises a bracket for mounting the sign to a flat surface. Preferably, the bracket is releasably connected to the sign, for example to one of two parts of a two part contruction sign.

Within this specification embodiments have been described in a way which enables a clear and concise specification to be written, but it is intended and will be appreciated that embodiments may be variously combined or separated without parting from the invention. For example, it will be appreciated that all preferred features described herein are applicable alone or in combination to all aspects of the invention, regardless of where they appear in the specification.

DETAILED DESCRIPTION

Example embodiments of the present invention will now be described with reference to the accompanying Figures, in which FIGS. 1 and 2 show examples of existing emergency exit signs;

The present invention relates to a dynamic guiding and lighting device working in conjunction with fire/evacuation computer modelling software to highlight egress in an emergency evacuation.

Recent academic studies have suggested and proven that the current British and European Emergency Exit Guidance signs are less effective as an aid to way-finding than they potentially can be. If they can be made to be more obvious and prompt movement while maintaining the simplicity and strength of the guidance information they provide, they are likely to become very effective due to high acceptance of signage information. To address this problem it is necessary to increase the affordance of the sign.

Figure 1:
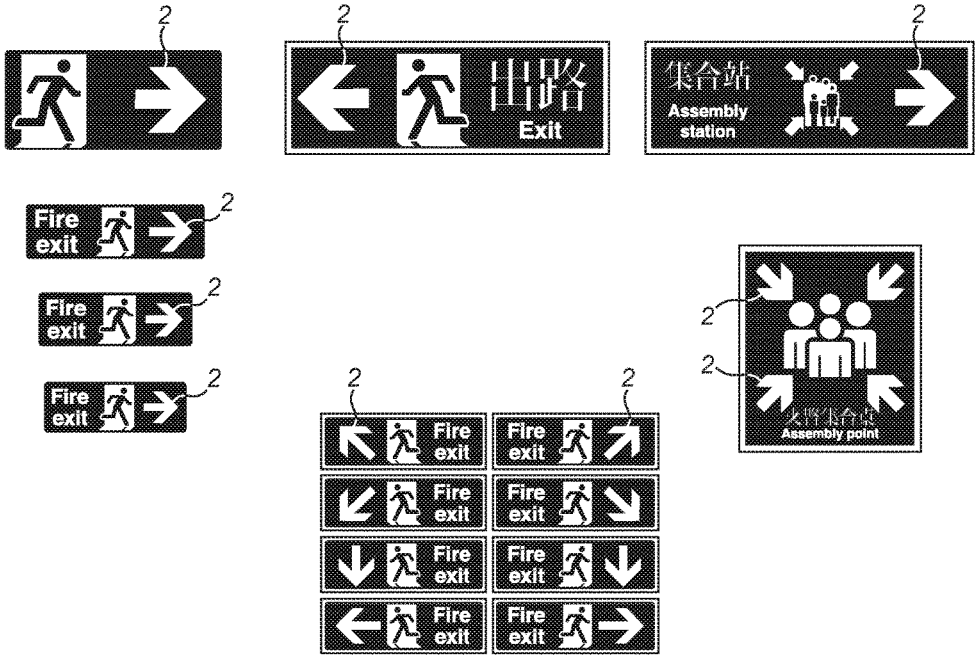
Figure 2:
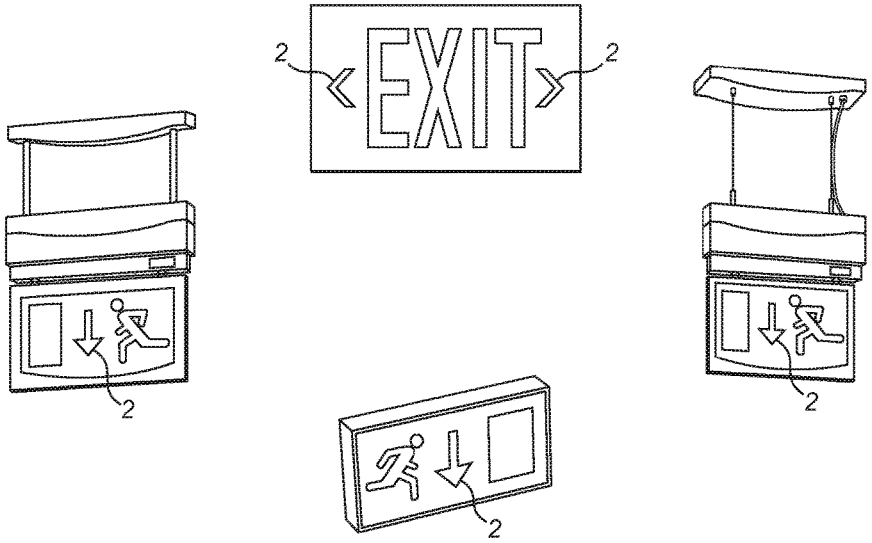

Numerous forms of evacuation signs exist and have been developed, installed and used throughout the world to assist occupants of structures in emergency evacuation situations. By design and to aid viewing, these signs are placed at height above doors and near ceilings and as such can become obscured by rising smoke. FIG. 1 shows a number of these signs. Most of these signs have a pictogram 2 such as a running man, a door, and an arrow, chevrons and the like indicating the direction to an exit or egress point as shown in FIG. 1. Further, some of these signs are backlit or edge-lit as shown in FIG. 2, or are in the form of labels that are photo-luminescent or just simple labels that are stuck on to walls such as shown in FIG. 1. The majority of the arrows, chevrons or the like components of these signs are static, that is, the component maintains the same form, message and intensity during an emergency. Further, the non-photo-luminescent label signs have been shown to be visible for a short period during power outages but are not providing any enhancements during a normal day-time evacuation or where there is no loss of light.

Most importantly, all these signs show the direction of the nearest exit; however they do not enable a change of direction should the circumstances deteriorate during an emergency evacuation. For example, a fire might start in the west wing of a building; however present mandatory signage cannot stop people heading towards emergency exits in that direction as they will be maintaining their static state and informational arrow or chevron and could potentially guide evacuees into the path of fire, smoke or even a terrorist threat in large public areas such as a shopping mall or transportation terminal. This then can cause not only loss of life but also confusion and congestion as evacuees that are not aware they are heading into a potential hazardous area are then met head-on by evacuees trying to get away from the hazard.

The present invention makes it possible to control such signage and allow a change of direction or to make a sign's route no longer available should the situation call for a redirection of the escape route. The present invention makes the sign more obvious and prompts movement to the exits whilst maintaining the simplicity and strength of the guidance information the signs provide. By doing so the sign of the present invention is more likely to achieve affordance due to high acceptance of signage information.

Figure 3:
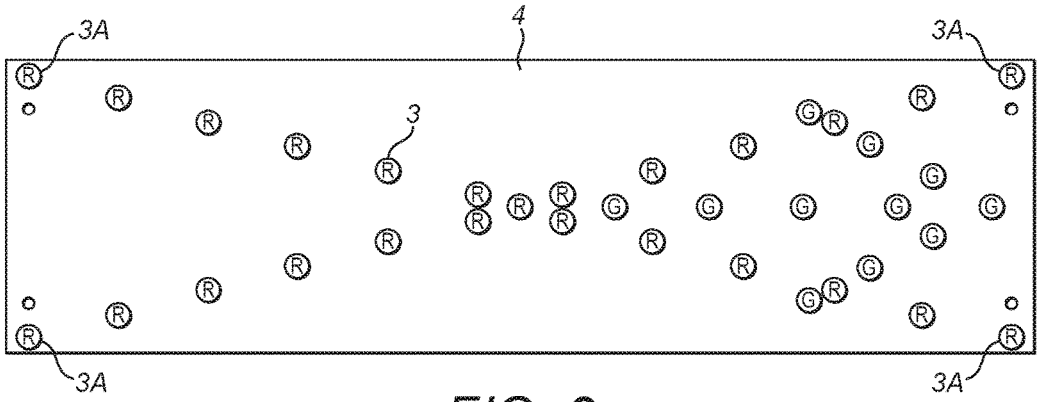
FIG. 3 shows an arrangement of LEDs provided on a printed circuit board (PCB) for use in the present invention.
Figure 4:
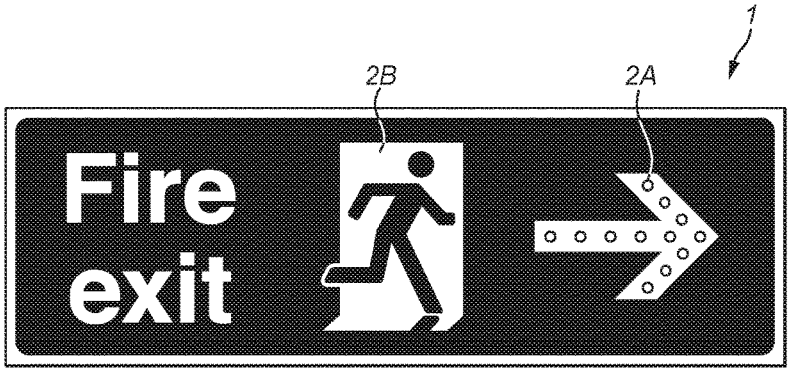
FIG. 4 shows illumination of an arrow on a sign of the present invention.
Figure 5A:
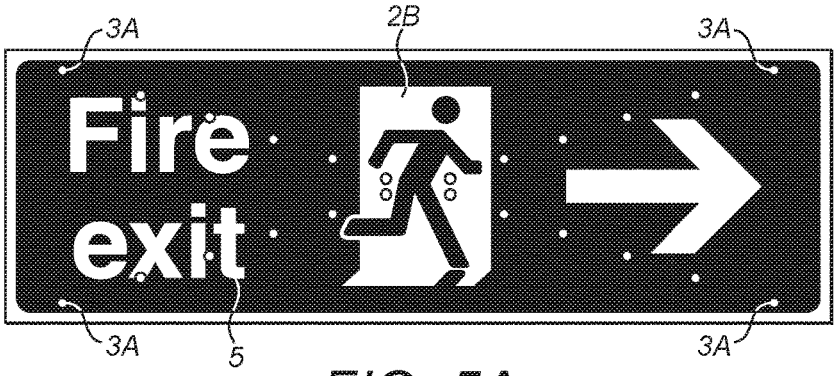
FIGS. 5A and 5B show the provision of a red cross on European and USA/UL924 signs of the present invention.

To achieve the affordance of Emergency Exit Signage this invention utilises a matrix of pulsating Light Emitting Diodes (LEDs) 3 components which are embedded on a printed circuit board (PCB) 4 as shown in FIG. 3 and positioned behind the Arrow pictorial 2A which is then interpreted as "proceed this way/Go" thus making the sign 1 active as shown in FIG. 4 rather than static/passive. An LED matrix is also incorporated on the PCB which enables a red cross (X) to cover all the pictograms 2A, 2B which signifies that this exit is no longer viable as an escape route as shown in FIG. 5A.

To further increase the light levels of the LEDs 3 showing behind the pictogram sign 1, a printing process of perforated printing can be used (also known as Contra Vision) which also keeps the required contrast levels of the sign according to standards. Furthermore the PCB 4 can be made of translucent material or coloured white to enable backlit signs to maintain LUX levels. The LEDs 3 form a green or white arrow behind the existing arrow pictogram and further LEDs 3 form a red cross (X) 5 running diagonally through the sign to all four corners as shown in FIG. 5A. The preferred activation for the correct sequence/activation of the LEDs 3 (either arrow 2A or cross 5) can be by information received via a building's Intelligent Fire/Evacuation Modelling Software, also known as Computational Fluid Dynamics (CFD) which has shown to be an effective means of directing egress during an emergency.

Figure 6A:
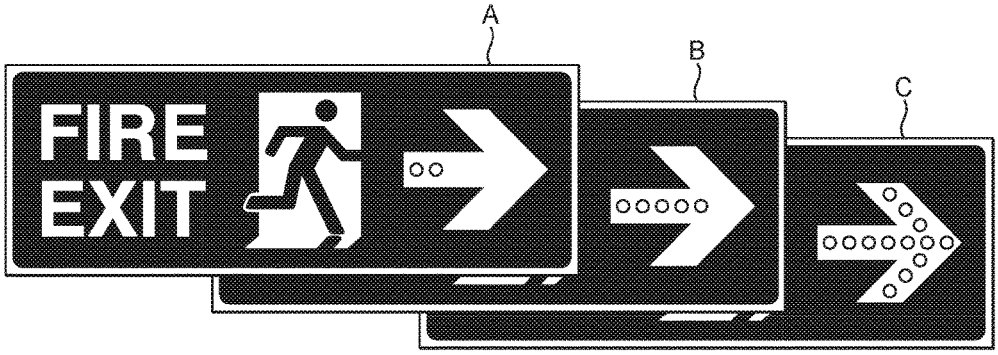
FIGS. 6A and 6B show sequential illumination of an arrow and chevron in signs of the present invention.
Figure 6A:
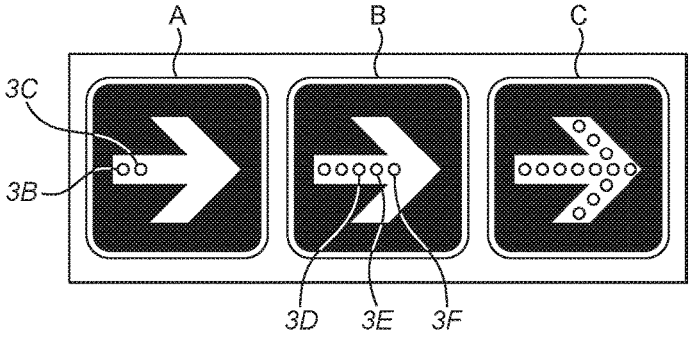
Figure 6B:
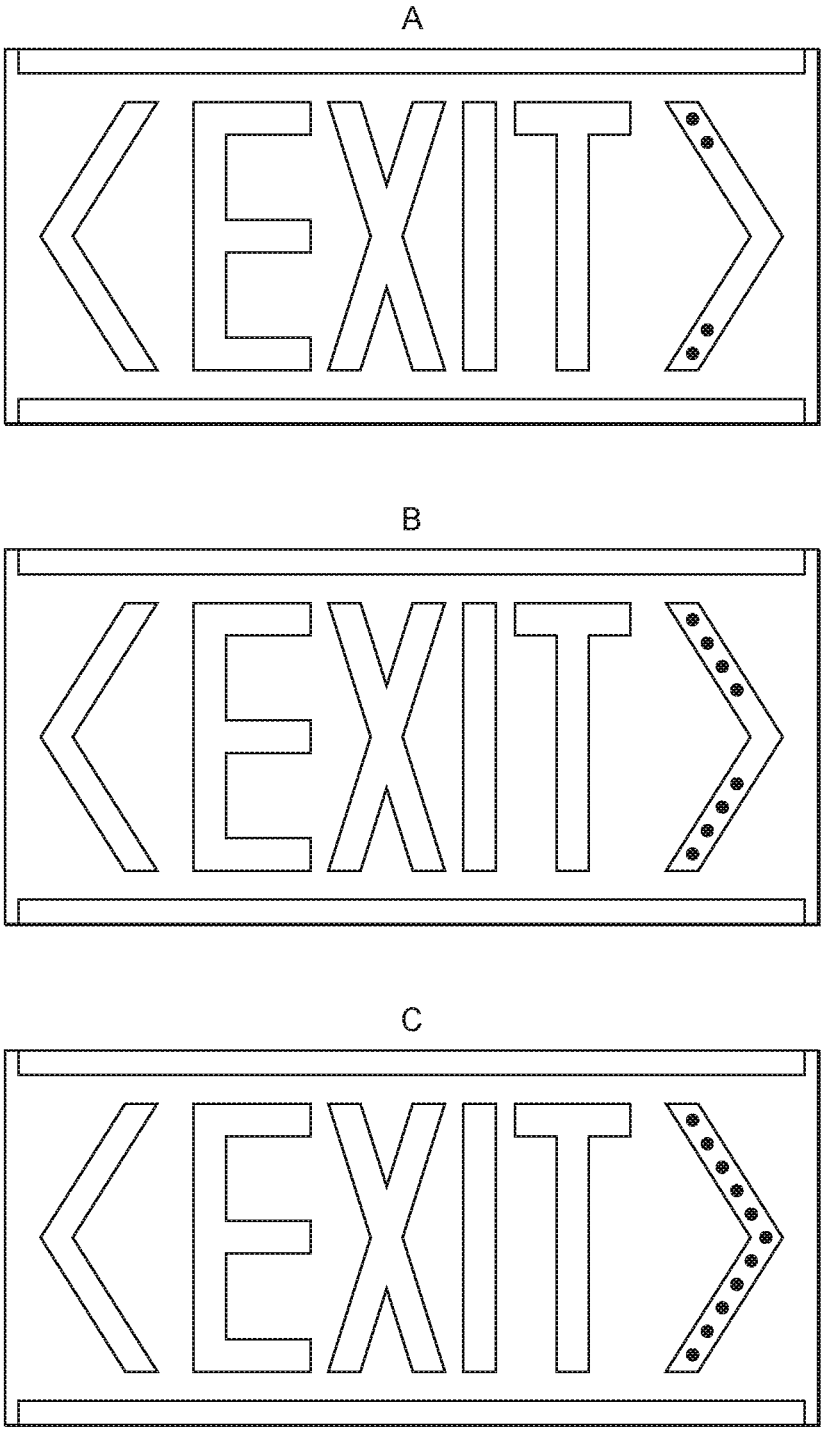
Figure 7:
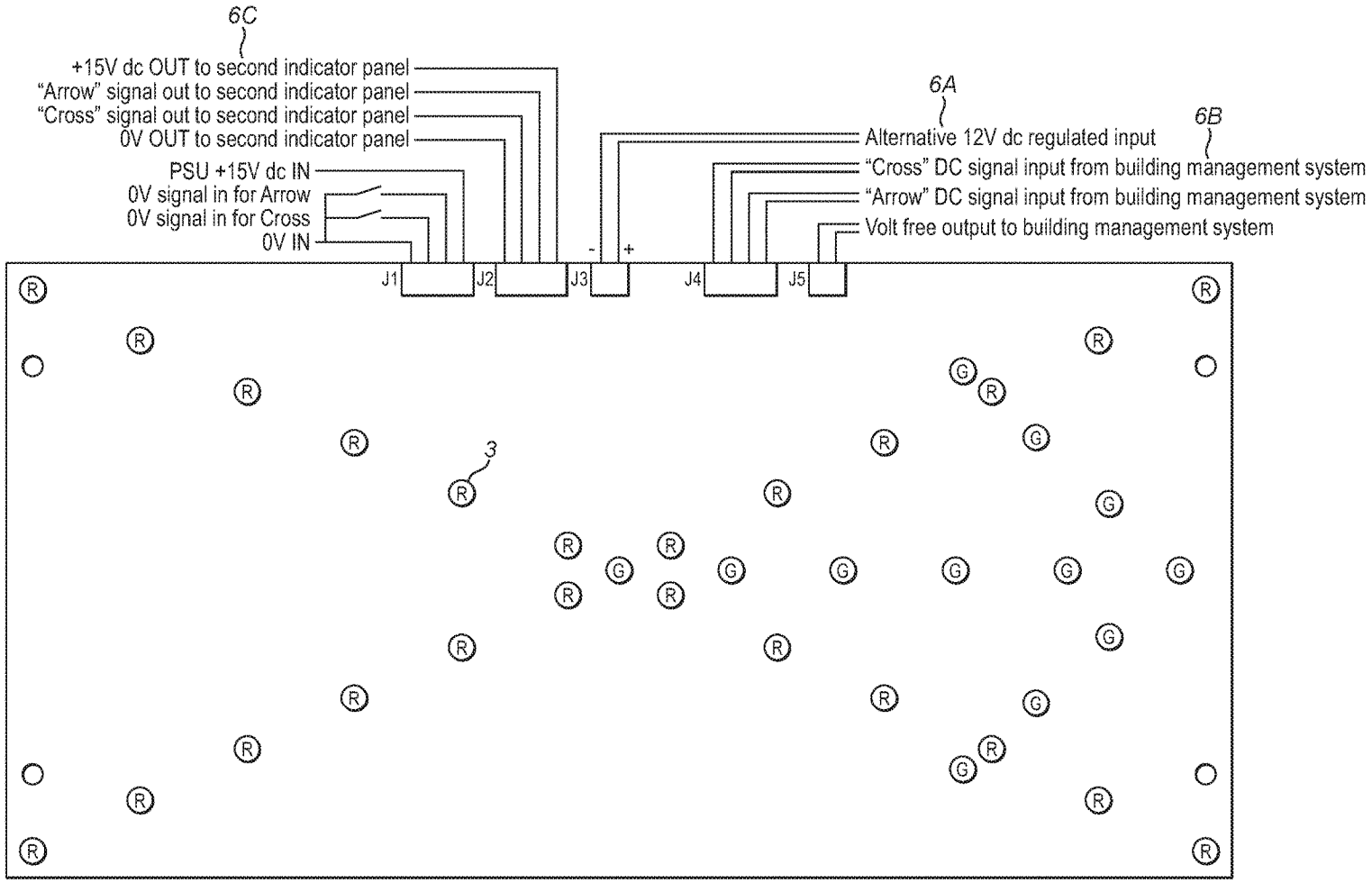
FIG. 7 shows an example of possible connections to a PCB for use in the present invention.
Figure 10:
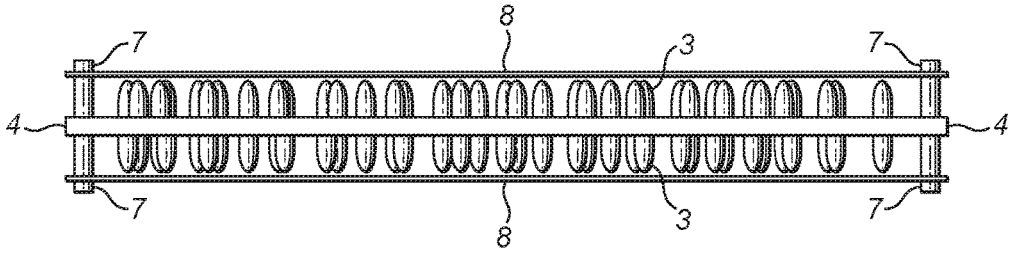
FIG. 10 shows a double-sided PCB positioned between two pictogram panels.
Figure 11:
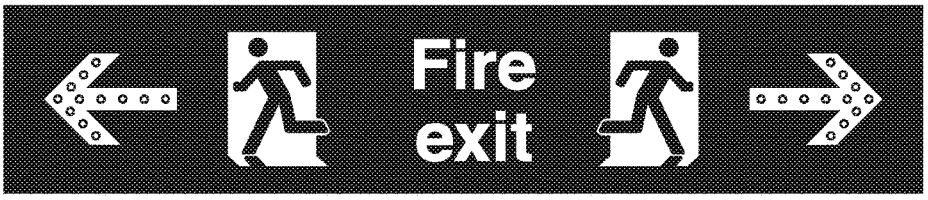
FIG. 11 shows an example of a sign being selectively illuminated to direct egress from a building towards the left and right.
Figure 12:
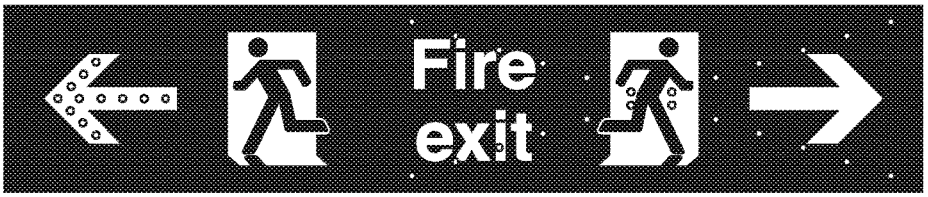
FIG. 12 shows an example of a sign being selectively illuminated to direct egress from a building towards the left, but discourage egress to the right.

The sign 1 has built in micro-processors and in/out connections 6 to the rear of the PCB 4 (as shown in FIGS. 7), 6A, 6B and 6C, to interpret this information and reacts accordingly by activating either the arrow or cross. Another important feature of the invention is a micro-processor which drives the LEDs in three sections/sequences, A, B and C, to form a moving arrow (as shown in FIG. 6) or pulsating cross (as shown in FIG. 5A). This is important in that it prompts people to move in the direction suggested by the sign (or not move if the red cross is showing). The chasing sequence of the LED arrow array will prompt people to action as tests have shown that the most time lost during an evacuation is in the Pre-Movement stage when people are indecisive as to what to do and are looking for guidance from staff present or some other form of guidance which could be people around them. The chasing sections of the arrow array can be of any number of LEDs forming a three section movement. Another important feature of the sign is its ability to be bi-directional left or right, up or down, diagonally up left, diagonally up right, diagonally down left and diagonally down right by extending the PCB to incorporate the appropriate sets of LED arrow arrays, as shown for example in FIGS. 11 and 12. Furthermore the sign can be double sided as shown in FIG. 10 with the LED PCB 4, PCB spacers 7 and the pictogram sign front 8.

The invention has the advantage of being visually active and will grab the attention of people trying to see in which direction the fire escape route in large public areas such as transportation terminals/airports is, where the invention will allow people to pick out the sign against the myriad of advertising signs also present and vying for attention.

People with hearing impairments will not necessarily hear the fire alarm but will be notified that there is an evacuation in progress by the active sign and that they need to follow the active instruction either arrow or cross (X) to safely exit the building. Some people with varying degrees of visual impairment will have more of a chance in seeing the bright LED arrows/cross to aid evacuation.

Where there is smoke present, this invention with its bright LED pulsating arrays could provide better visual awareness than standard fluorescent tube exit signs and photo-luminescent signs.

There are no limitations as to the power source for the activation of the sign, for example batteries, DC and AC electricity, mechanical, solar among other energy sources can be used. However, the most preferred source of energy would be AC and connected and triggered by fire/evacuation software.

Figure 8:
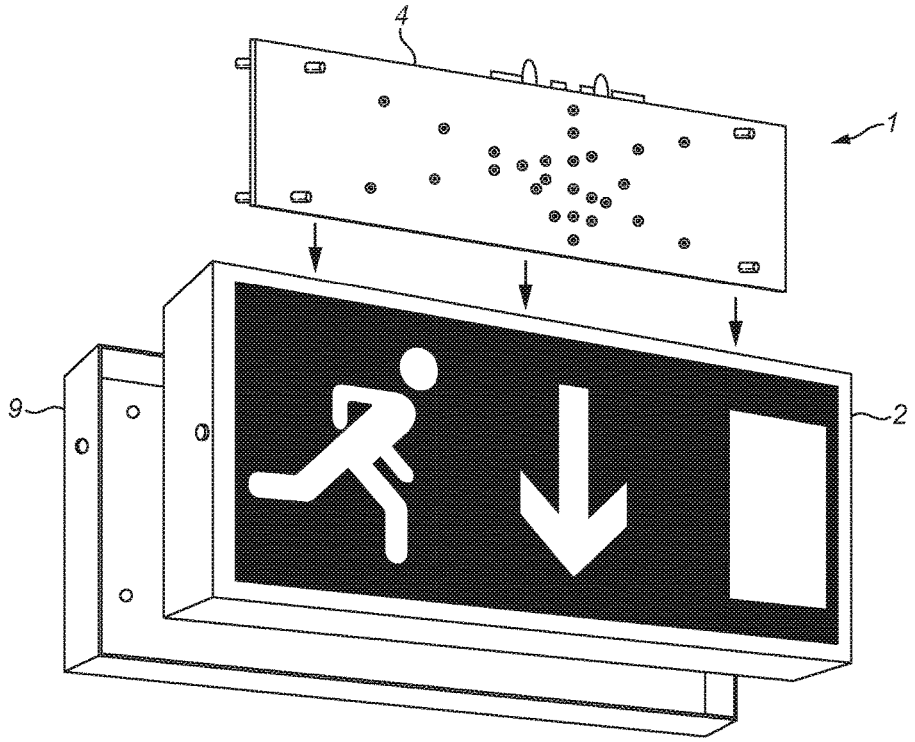
FIG. 8 shows the positioning of a PCB behind the pictogram of a sign of the present invention.
Figure 9A:
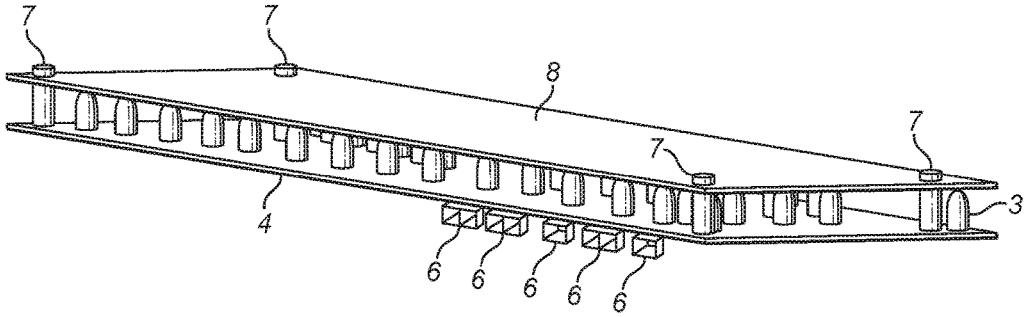
FIG. 9A shows a perspective view of a PCB for use in the present invention.
Figure 9B:
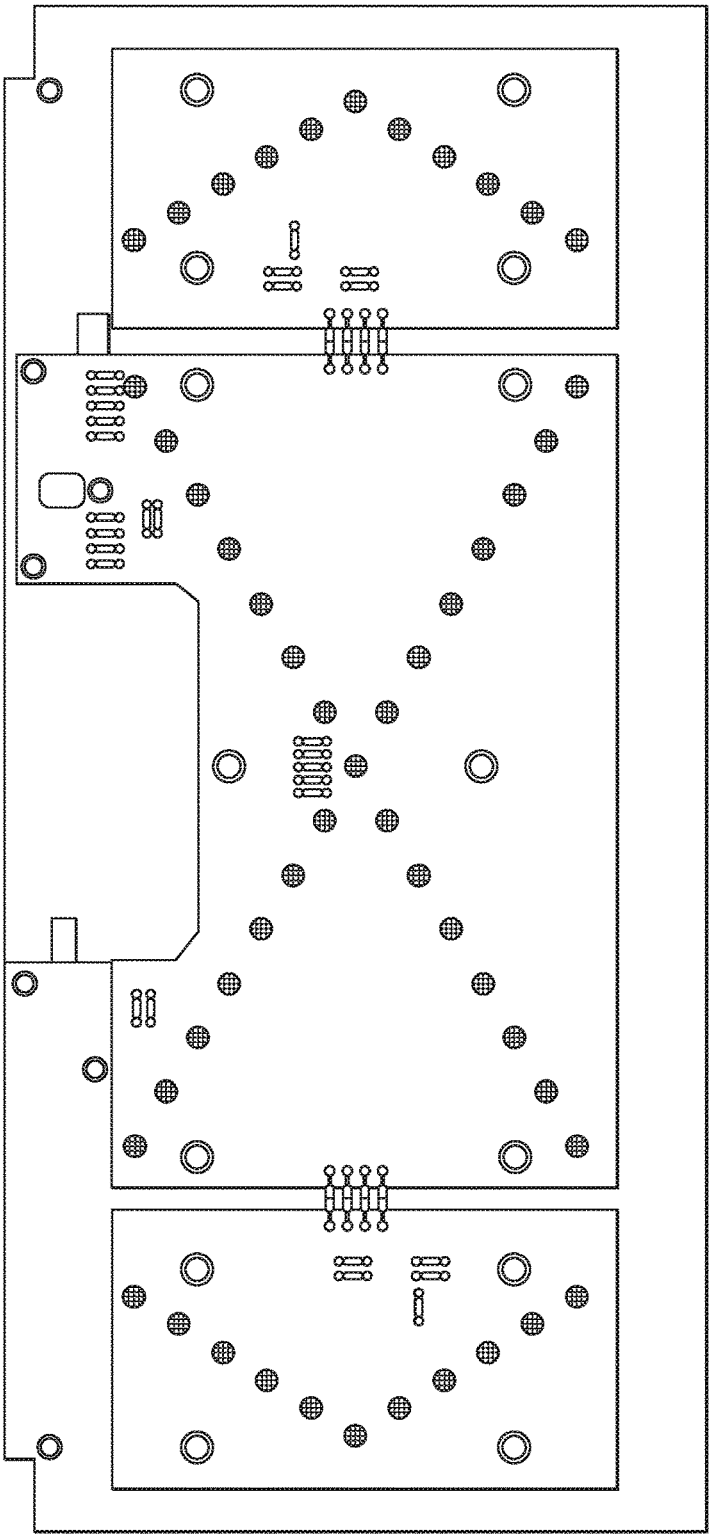
FIG. 9B shows a plan view of a PCB for use in the present invention.

The present invention can be retro-fitted into standard British & European lit exit/escape route signs as shown in FIG. 8. The enhancement is achieved by fitting the printed circuit board 4 matrix of light emitting diodes ("LEDs") behind the pictogram 2 of the sign such as in FIG. 8. The PCB can incorporate outlets as shown in FIG. 7 items 6A and 6B, for various types of power source i.e. batteries or AC/DC. The LEDs 3 are activated to project light transverse the surface of the arrow (FIG. 9A) to render the arrows of FIG. 4 from static to dynamic. The LEDs 3 and other working parts can be hidden within any type of enclosure to the back 9 of the sign 1 as shown in FIG. 8 and can be enhanced by special printing processes of the pictogram sign.

A matrix of LEDs 3 is schematically shown in FIG. 7. The LEDs in the matrix are wired and micro-processor controlled to for instance, be chasing or flashing (as shown in FIGS. 6, A, B and C).

There are no limitations as to the type of triggering mechanism to activate the matrix. For example:

- An electrical feed from a CFD Modelling software programme can be used to activate the appropriate LED matrix of arrow or cross.
- An appropriate radio receiver can be used to activate the LED matrix upon receiving a radio signal from radio transmitter, whereby the radio transmitter has been in turn activated by a signal from the fire/evacuation computer modelling software.
- An appropriate radio receiver can be hard wired to a fire alarm panel receiving its signal direct from the fire/evacuation computer modelling software.
- The invention can be hard wired to a fire alarm loop.
- The invention can be hard-wired to an emergency lighting circuit.
- The invention can receive a signal from Mains Power Signalling devices.
- The invention can receive signals from mesh-networking also known as Zig-Bee(RTM).

There are no limitations as to the control of the LEDs, the light sources can chase each other, strobe, blink, selectively turn on and off among other variations.

There are no limitations of applications of such embodiments, for example, the embodiments of the present invention may be used to guide evacuees during emergency and non-emergency events.

There is no limitation as to the type of pictorial Fire Escape Route sign used.

There are no limitations on how the embodiments are attached to a wall, for example, or hanged from a ceiling.

It is noted that although the present invention thus far has referred to using the LED matrix to accentuate an arrow or a chevron of a static sign, the number of arrows or the chevrons is not limited to one.

It is noted that the present invention thus far has referred to using the LED matrix to accentuate an arrow or a chevron of a static sign or red cross (X). Other parts of the sign such as the "running man" or "doorway" can be accentuated either singly or in combination thereof.

It is further noted that pictorials of the present invention can be on a transparent and/or translucent/perforated substrate, and the pictorials can be formed of phosphorescent paint.

Therefore, the present invention relates broadly to accentuating one or more of the pictograms of a static emergency exit/route sign by using the light emanated from a light source, and more specifically from a matrix of LED light sources, controlled by signals from fire/evacuation computer modelling software to assist occupants egress in emergency or other critical situations.

Particularly preferred embodiments of the present invention relate to the following numbered embodiments:—

1. An active LED array Fire Exit Escape Route sign that interprets fire/evacuation computer modelling software to show/change the direction of escape or bar an escape route exit from being used.
2. The LEDs according to embodiment 1, which either flash or chase to create a moving arrow in the required direction or static/pulsating red cross to stop/hold an exit from use.
3. The invention according to embodiment 2, which can also be multi directional with the arrow directing up/down or /left/right and/or diagonally up left/right or diagonally down left/right.
4. The invention according to any of the preceding embodiments which can also be manufactured as a complete Fire Emergency Escape Route/Exit sign or retrofitted into existing signs.

This invention addresses the problem of recent studies which show that present day emergency escape signage is not as effective as it could be. Present signs show the direction to the nearest exit however most importantly they do not enable a change of direction should the circumstances deteriorate during an evacuation.

This invention increases the affordance of the sign by the use of a matrix of LEDs embedded into a printed circuit board and forming the shape of the pictogram arrow present in British & European Exit Signs, with the addition of further LEDs forming a cross which tell the evacuee not to proceed past this sign. This invention works in conjunction with Fire/Evacuation Computer Modelling software which allows the micro-processor on the PCB to change which LED array is lit, ie Arrow "to go" (FIG. 11) or red cross (X) to "don't go" (FIG. 12), according to the information received.

The present invention relates to a dynamic emergency fire exit sign that retains all the current features and benefits of standard fire exit signage, for example, an enclosure with top and side walls, a panel or panels with pictogram or wording information, a power source with power back-up supply and some form of illumination. However, the invention also comprises additional components set within the enclosure of the sign, for example a matrix of controllable LED arrays set on a printed circuit board/boards in the form of an LED arrow/chevron array to signify "proceed this way/Go" and an LED cross array to signify "don't proceed this way/don't enter" to enhance the effectiveness and affordance of these signs such as depicted in the standards ISO7010/ISO3864-1 and UL924.

In one embodiment of the invention, in order to increase the affordance of the sign, in particular to the standards set out in UL924, the size of the chevron is increased to match the standard height requirement of the word EXIT.

Further objectives are achieved by the enhancement and addition of electrical components, namely controllable LED arrays set on a printed circuit board to enhance the effectiveness and affordance of these signs such as depicted in the standards ISO7010/ISO3864-1 and UL924.

By retaining the style of these signs set out in the standard signs worldwide, no training of the public is required to understand this dynamic fire exit sign.

In one embodiment, printed circuit boards containing a matrix array of pulsating Light Emitting Diodes (LEDs) are set out in a pattern and spaced within the sign's enclosure by way of a central chassis running parallel to the pictograms on one or both sides and central within the enclosure.

Preferably, the LED arrays are specifically set behind the pictograms or wording of the sign and preferably form either an arrow or chevron behind the printed arrow or chevron of the translucent panels. The LEDs may form a cross whose four outer points extend to the four corners of the sign's acrylic or glass panels or outer edges of the pictograms, symbols or wording.

When the LEDs are activated, this not only draws the eye to the sign's position but also highlights the direction of escape. The LEDs prompt people to move in the required direction due to a pulsating effect of the LEDs and can be controlled to be multi-directional from both or one side of the sign and/or stop an exit from being used where it is not safe to do so by the cross (X) LED array. This cross has been found to be most effective and understood when covering all parts of the pictograms or symbols of the sign as shown in FIG. 5A.

The LED array that forms the cross (x) can be incorporated on the same PCB to aid design, for example for signs covered under standard ISO7010; however a separate LED array can also be used.

Depending on the viewing distance required for the sign, multiple LEDs can be mounted on varying sizes of PCBs to form a cross. For example, for a sign with a viewing distance of 40 meters, the LEDs form a cross of two straight lines, with each line incorporating sufficient number of LEDS to reach the four corners of the sign as shown in FIG. 5A.

The LEDs of the cross are preferably red in colour to denote danger but can be any colour. Most of the LEDs in the cross remain static in an illuminated state; however to attract the eye, four extra LEDs 3A can be mounted on the PCB in the extreme four corners of the PCB and can be pulsed in any combination, such as top left and bottom left illuminating together then top right and bottom right illuminating together with this sequence repeating such that the left and right sided LEDs of the sign are alternately switched on and off in a synchronised manner. Other sequences could be used, for example top right and top left illuminated followed by bottom left and bottom right illuminated.

For signs covered under UL924, the cross can cover just the word EXIT or the cross can extend to all four corners of the sign covering the word EXIT and Chevrons.

It is preferred that the sign becomes dynamic only when there is a requirement to evacuate and in normal use retains all the features of standard illuminated fire exit signs. Accordingly, should the dynamics of the sign ever fail to operate the sign will retain the original requirements and features/luminance of the mandatory code(s). This provides a fail-safe.

Preferably, the LEDs behind the arrow/chevron are set out to follow the shape of the outer printed arrow or chevron. There are no limitations as to how many LEDs would be required to form this shape according to different sized pictograms as set out within the various international standards which call for varying size pictograms to make the sign visible from different viewing distances.

The LEDs can be of any colour; however the preferred colour for "GO/Proceed" is green and these are pulsated in any series of combinations. A preferred combination is a three step series which can be interpreted as "proceed this way/Go".

Figure 5B:
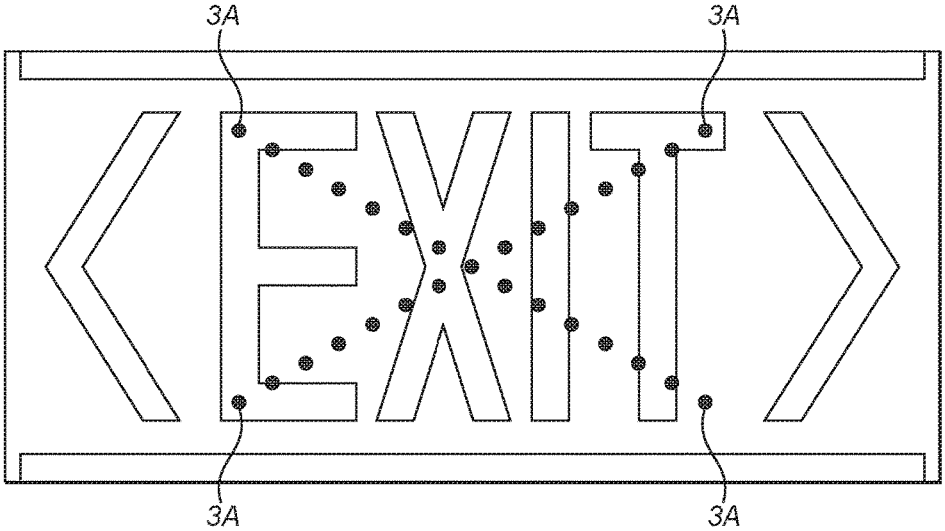

When the LEDs are activated they make the sign dynamic/active rather than passive/static as shown by the arrow array in FIG. 4 and cross array in FIG. 5. For example, if using the arrow pictogram from the standard ISO7010, the sequence of lighting each LED is not limited but the preferred sequence is to light up LEDs along the shaft of the arrow and the triangular part of the arrow to its apex as shown in FIG. 6A, by the sequence of steps A, B and C.

Pulsating the LEDs in a three step repeating sequence has been found to be particularly effective. For example, using a sign with a viewing distance of 40 meters and the appropriate number of LEDS required to sufficiently light up the arrow, the first series of LEDs to be illuminated could be along the shaft of the arrow lighting up for instance LEDs 3B and 3C, followed by the second series of LEDs 3D,3E and 3F together on the shaft, and then followed by the third series of LEDs running from the outer edges of the pointed arrow part of the sign to the apex of the arrow which are all pulsed together.

However for signs such as covered under standards UL924 that have chevrons, which have no shaft, the preferred method would be to pulsate the LEDs again in a three step series running from the outer edges of the chevron to the centre/apex of the chevron. This is shown in FIG. 6B.

To further increase the affordance of the chevron set out under the standard UL924, the size of the chevron is preferably increased to match the standard height requirement of the word EXIT.

Depending on the viewing distance required, the LED array might contain more or less LEDs to adequately replicate the three step series.

Recent academic studies using the present invention within the style of sign set out in the standard ISO7010 have shown a significant improvement of 44% in the decision time taken by people to go either left or right at a corridor junction of a building which in turn has produced an overall improvement in getting people out of potentially hazardous buildings and has performed better than standard signage by some 103%.

The central chassis can secure a PCB 4 of LEDs 3 for a single or double-sided dynamic sign as shown in FIG. 10. This has the advantage of conveying different evacuation messages on either side of the sign to overcome the problem of potentially sending people into a hazardous area and to create positive flows of people during an evacuation.

One such example is for ISO7010/ISO3864-1 types of double sided signage situated in a corridor of a building where there is a flow of people traffic going in both directions. On one side of this double-sided sign it can show a pulsating cross in the form of red LEDs as shown in FIG. 5A which means "don't proceed/don't enter". Whilst on the other side of the double-sided sign the LEDs can show a pulsating arrow behind the pictogram arrow as shown in FIG. 4 to convey "proceed this way/Go".

For UL924 double-sided signs, on one side of the double sided sign it can show a pulsating cross in the form of red LEDs which means "don't proceed/don't enter" whilst on the other side of the double sided sign the LEDs can show a pulsating chevron set behind the pictogram chevron to convey "proceed this way/Go".

Figure 13:
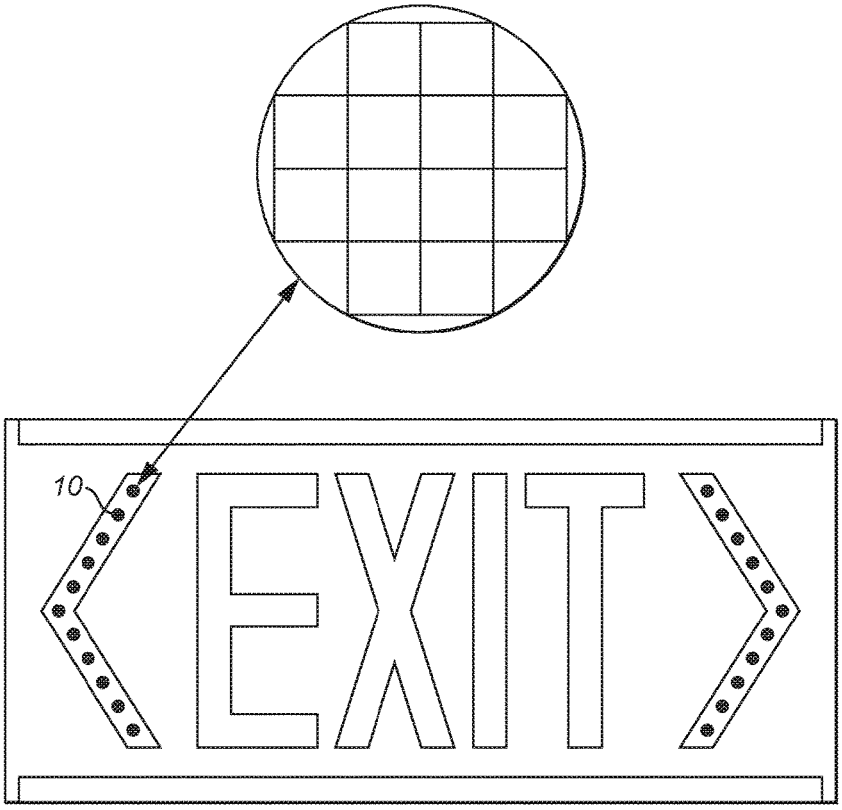
FIG. 13 shows an example of the linear square grid printing layout for use in the present invention.

A further enhancement has been to increase the light levels of the LEDs showing behind the pictogram signs facia without bleeding light into other areas of the sign. This is achieved by applying a masking print process to the inner side of a sign's facia with circular cut outs positioned where the LEDs would align with the sign's pictograms and/or wording. These circular cut outs 10 are further enhanced by leaving small pixels of print within these circular areas 10 so as to keep the outer pictograms and/or wording visible and to maintain the contrast levels of the sign's message. The small circles of print 10 comprise a square grid pattern as shown in FIG. 13. The square grid pattern allows even more light to permeate the outer graphic whilst retaining the graphics image from a distance.

As with standard emergency exit/route sign requirements, the dynamic sign is ideally provided with an alternating current supply. The electrical power supply further includes an emergency direct current power supply and a switching device for switching between the two power supplies if the alternating current power supply fails. It is also possible to utilize nickel-cadmium batteries, the smaller Ni—Cd battery being mounted within the interior of the enclosure. A releasable connector is provided to the power supply so as to facilitate connections to the printed circuit boards.

As also described elsewhere herein, in order to make the sign dynamic/active, the LED arrays within the sign/pictograms can be activated for the correct sequence/activation of the LEDs via various inputs to the PCB, as shown in FIG. 7. These signal inputs can be from any of the following:

a) received for example via a direct or indirect link to a fire alarm panel;
b) via a digital acoustic listening device either linked to the fire alarm panel or connected directly to the PCB within the dynamic sign;
c) via a lighting management system such as DALI;
d) via a buildings Intelligent Fire/Evacuation Modelling Software system, also known as Computational Fluid Dynamics (CFD) which has shown to be an effective means of directing/anticipating the best egress route during an emergency when linked to a building management software;
e) or any other appropriate building management system;

The signal inputs can be manually controlled via CCTV monitoring and the appropriate software to control the signs, via a wireless transmitter with a receiver module on the PCB, through Mains Power Signalling, or through Zigbee mesh networking systems.

The LEDs used in the present invention can be of any type.

This invention has many benefits over and above present standard fire exit signage around the world presently covered by the various standards such as ISO7010/ISO3864-1 and UL 924.

The present invention addresses the problem highlighted by recent studies which have shown that present day emergency exit signage is not as effective as it could be. Present signs cannot show a change of direction from the original route should this route deteriorate during an emergency and these signs can be difficult to pick out in a myriad of other forms of signs.

The present invention overcomes these issues by the use of a matrix of pulsating LEDs embedded on printed circuit boards located centrally within the sign's enclosure and highlighting the shape of the pictograms arrow or chevron along with an additional matrix forming the shape of a cross to negate an exit from being used. The LED matrixes of arrow/chevron or cross can be individually controlled on one or both sides of the sign via modules on the PCB to accept signals from varying inputs.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications are covered by the appended claims.

The invention claimed is:

1. A dynamic sign for dynamically indicating only during an emergency an escape route from a building, the dynamic sign comprising fixed exit information illuminated at a first luminance by at least one first light source, and overlayed evacuation route information illuminated, at a second luminance brighter than the first luminance by at least one second light source different from the at least one first light source, only during an emergency in response to an alarm input, wherein the dynamic sign comprises a plurality of areas of increased light permeability for light from the at least one second light source to pass at the second luminance, wherein the plurality of areas of increased light permeability comprise a perforated printed surface, and wherein the overlayed evacuation route information is illuminated in a repeating sequence of at least three sequential steps.

2. The dynamic sign according to claim 1, wherein the plurality of areas of increased light permeability comprise one or more circles of perforated printing.

3. The dynamic sign according to claim 1, wherein the plurality of areas of increased light permeability comprise a square grid pattern.

4. The dynamic sign according to claim 1, wherein the plurality of areas of increased light permeability are positioned in alignment with the at least one second light source.

5. The dynamic sign according to claim 1, wherein the at least one second light source comprises a plurality of LEDs, and each of the plurality of LEDs is positioned behind a separate one of the plurality of areas of increased light permeability.

6. The dynamic sign according to claim 1, wherein the at least one first light source is provided behind a panel comprising the fixed exit information.

7. The dynamic sign according to claim 1, wherein the dynamic sign further comprises a first face comprising the fixed exit information and a second face comprising the overlayed evacuation route information, the at least one first light source illuminating the fixed exit information provided on the first face, and the at least one second light source illuminating the overlayed evacuation route information on the second face.

8. The dynamic sign according to claim 7, wherein the at least one second light source comprises a plurality of separate LEDs each controllable independently to dynamically highlight different portions of the overlayed evacuation route information on the second face.

9. The dynamic sign according to claim 7, wherein the at least one second light source comprises a plurality of light sources each specifically arranged behind individual items of the overlayed evacuation route information.

10. The dynamic sign according to claim 1, wherein the at least one second light source illuminates a cross.

11. The dynamic sign according to claim 10, wherein the cross extends across the fixed exit information.

12. The dynamic sign according to claim 10, wherein at least part of the cross flashes in use.

13. The dynamic sign according to claim 1, wherein the overlayed evacuation route information comprises one or more pictograms and/or one or more words.

14. The dynamic sign according to claim 13, wherein the one or more pictograms comprise one or more arrows, chevrons, running men and/or doorways.

15. The dynamic sign according to claim 13, wherein the overlayed evacuation route information comprises the one or more pictograms, and the at least one second light source is located behind the one or more pictograms.

16. The dynamic sign according to claim 13, wherein the overlayed evacuation route information comprises the one or more pictograms, and the at least one second light source forms a shape of one or more of the one or more pictograms.

17. The dynamic sign according to claim 1, wherein the at least one second light source is activated by an alarm system to illuminate either an arrow or a cross as the overlayed evacuation route information.

18. The dynamic sign according to claim 1, wherein the dynamic sign further comprises a micro-processor which drives the at least one second light source in a sequence to form a moving arrow or pulsating cross as the overlayed evacuation route information to prompt people to move in a direction suggested by the dynamic sign or not to move if the overlayed evacuation route information comprises an illuminated red cross.

19. The dynamic sign according to claim 1, wherein the at least one second light source is controlled to be chasing or flashing.

* * * * *